United States Patent [19]

Karavaev et al.

[11] 4,398,609

[45] Aug. 16, 1983

[54] APPARATUS FOR SINKING WELLS IN THE GROUND

[75] Inventors: Andron T. Karavaev; Vladimir D. Plavskikh; Alexei D. Terskov; Anatoly V. Sukhushin; Nikolai P. Chepurnoi; Evgeny N. Cherednikov, all of Novosibirsk, U.S.S.R.

[73] Assignee: Institut Gornogo Dela Sibirskogo Otdelenia Akademii Nauk SSSR, USSR

[21] Appl. No.: 357,580

[22] Filed: Mar. 12, 1982

[51] Int. Cl.[3] ..... E21B 7/26

[52] U.S. Cl. ..... 175/19; 175/21; 173/91

[58] Field of Search ..... 175/19, 21; 166/178; 173/91, 139; 405/184

[56] References Cited

U.S. PATENT DOCUMENTS

| | | | |
|---|---|---|---|
| 1,403,766 | 1/1922 | Gillies | 175/19 |
| 3,550,698 | 12/1970 | Pauley | 175/19 |
| 4,171,727 | 10/1979 | Tkack et al. | 175/19 |
| 4,295,533 | 10/1981 | Schmidt | 175/19 |

*Primary Examiner*—Ernest R. Purser
*Assistant Examiner*—Thuy M. Bui
*Attorney, Agent, or Firm*—Robert E. Burns; Emanuel J. Lobato; Bruce L. Adams

[57] ABSTRACT

A specific feature of the apparatus according to the invention which incorporates a percussion unit to a tail piece whereof there is attached a rope connecting to a means of extracting is that fitted into said tail piece coaxially therewith and with a clearance is a ring, the clearance between said ring and said tail piece containing a resilient member with passages reeved wherethrough are the ends of the rope and the inside surface of said tail piece being provided with stops in the body whereof there are also passages for reeving the ends of the rope.

4 Claims, 5 Drawing Figures

APPARATUS FOR SINKING WELLS IN THE GROUND

APPARATUS FOR SINKING WELLS IN THE GROUND

The present invention relates to construction plant and has specific reference to apparatus for sinking wells in the ground.

The invention may be used to advantage at well sinking rigs, for example, in retrieving a tool with the aid of the means of extracting fastened to the tail piece and pulled by a winch.

In use during well-sinking operations in unstable (water-saturated) ground as well as in sinking vertical wells is a safety rope.

There is known an apparatus wherein the safety rope can be attached to the tail piece by welding. However, in this case the safety rope cannot be disconnected from the apparatus in those instances when it appears to be redundant, e.g. in driving horizontal boreholes in dense ground.

The main disadvantage of said apparatus is the breaking of the rope away at the weld under the impact loads arising during operation.

Highly popular is a device for attaching the rope which incorporates a percussion unit to the tail piece whereof there is fastened the rope connecting to a means of extracting. In said device, the ends of the rope are provided in the form of brackets the forward part whereof is bent at least twice and accommodated in openings of a housing. This plan solves the problem of a speedy engagement and disengagement of the rope.

However, a short service life of the device is an obvious limitation. The ends of the rope secured in a cantilevered fashion in the brackets cannot stand to the impact loads and break after 10 to 15 hours of operation.

It is an object of the present invention to eliminate said limitations.

The main object of the present invention is to enhance operational reliability of the apparatus as a whole.

A further object of the invention is to extend the service life of the apparatus.

Yet another object of the invention is to simplify the apparatus and shorten the period of adjustment thereof.

Said and other objects are realized by the fact that in an apparatus for sinking wells in the ground, which incorporates a percussion unit to a tail piece whereof there is attached a rope connecting to a means of extracting, there is provided a ring fitted into said tail piece coaxially and with a clearance, the clearance between said ring and said tail piece containing a resilient member with passages reeved wherethrough are the ends of the rope and the inside surface of said tail piece being provided with stops in the body whereof there are also passages for reeving the ends of the rope.

It is expedient that the surface of the resilient member, that of the ring and the inside surface of the tail piece are taper-shaped. The rope can be provided with end-face passages having stops.

Said features of construction uniformly distribute and minimize the impact loads, thus extending the service life of the apparatus as a whole.

The essence of the invention is as follows.

The resilient member contained in the clearance between the tail piece of the percussion unit and the ring coaxially fitted into the tail piece, i.e. at the place of contact, serves to dampen the impact loads arising in the rope due to the action of the percussion unit. The ring ensures a reliable attachment of the resilient member to the tail piece. Furthermore, the passages in the body of the resilient member reeved wherethrough are the ends of the rope increase the area of the contact between the resilient member and the rope, contributing to a further reduction of the impact loads coming on the rope due to the percussion unit. At the same time, the stops provided on the inside surface of the tail piece and in the end face of the ring give adequate support to the tail piece in contact with the percussion unit and transmit to the tail piece the effort applied to the means of extracting. The passages in the body of the tail piece and the ring and the taper-shaped surfaces of the resilient member and the ring in conjunction with the taper-shaped inside surface of tail piece cater for reliable fastening of the rope to the tail piece without slipping.

All in all, the disclosed apparatus combines structural simplicity with reliability and durability, the service life thereof amounting to 500–600 running hours. Noteworthy is also the ease of taking the apparatus apart.

Other objects and advantages of the invention will become obvious from the following detailed description thereof and the accompanying drawings in which FIG. I is a side elevation, partly cut away, of the apparatus for sinking wells in the ground according to the invention;

Figure 1:
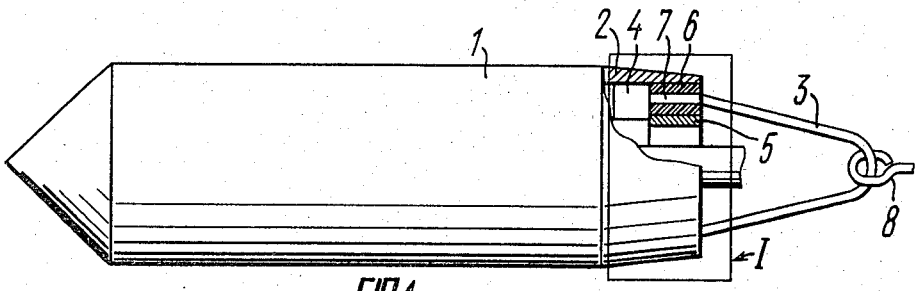

Referring to FIG. I, the apparatus for sinking wells according to the invention incorporates a percussion unit I in a tail piece 2 whereof there are fastened ends 4 of a rope 3. Said ends consist of sleeves slipped on the rope 3 and crimped under a press, and the fastening is effected by means of a ring 5 and a resilient member 6. Said member 6 is provided with passages 7 reeved wherethrough are the ends of the rope 3 connected at the inflection to a means of extracting 8.

Figure 2:
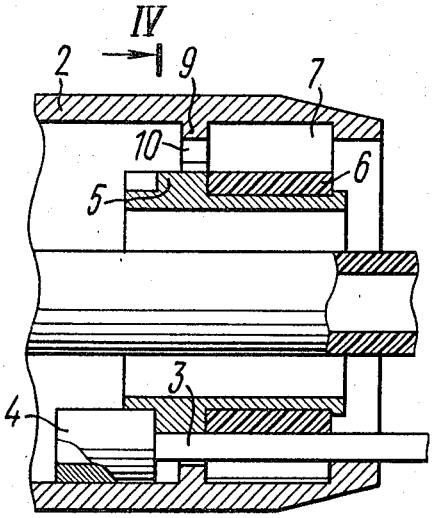
FIG. 2 is a view of the framed portion I in FIG. I on an enlarged scale.
Figure 3:
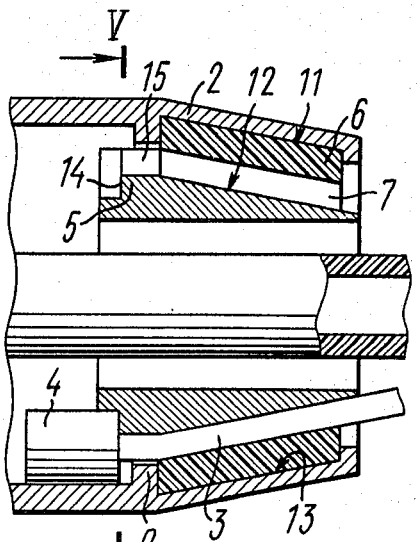
FIG. 3 is a view similar to FIG. 2 depicting another embodiment of the invention.
Figure 4:
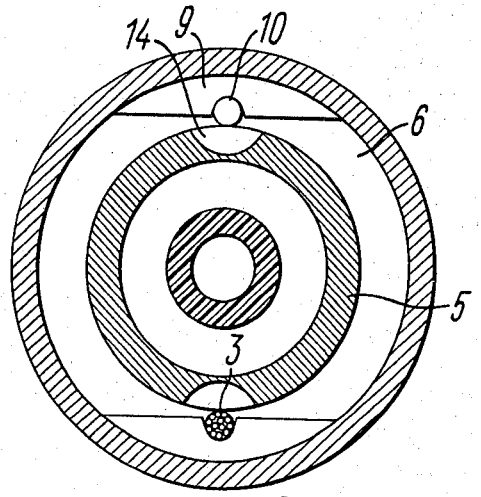
FIG. 4 is a section on line IV-IV in FIG. 2.
Figure 5:
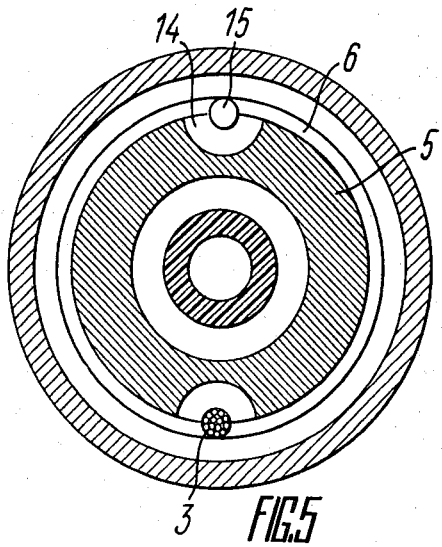
FIG. 5 is a section on line V-V in FIG. 2.

Referring to FIG. 2, the inside surface of the tail piece 2 is provided with stops 9 having passages 10 also reeved wherethrough are the ends 4 of the rope 3.

The surfaces II of the resilient member 6, the surfaces 12 of the ring 5 and the inside surface 13 of the tail piece 2 can be taper-shaped so as to prevent slipping of the rope. The ring 5 can be provided with an end-face stop 14 having passages 15 reeved wherethrough are the ends of the rope 3. (The rope 3 together with its ends 4 are not shown in the upper halves of FIGS. 2, 3, 4 and 5).

Consider the way the apparatus for sinking wells in the ground operates.

On sinking the well to a specified depth (or driving the borehole to a specified length), the operating percussion unit is extracted from the ground by pulling at the rope 3, using a winch 8 or any other suitable means of extracting. Said procedure is unavoidable, especially in a weak water-saturated ground.

The resilient member 6 prevents the impact loads set up in the parts when the percussion unit I is in operation from influencing the components effecting the joint between the rope and said unit, safeguarding said components from damage and extending the service life of the apparatus; the resulting stresses decrease and the reliability of the apparatus increases.

Thus, the disclosed apparatus for sinking wells in the ground reduces the effect of the impact loads on the components of the fastening of the rope which is a factor predetermining the effectiveness of said apparatus in working backfilled and water-saturated grounds.

What is claimed is:

1. An apparatus for sinking wells in the ground incorporating a percussion unit with a tail piece, a ring fitted into said tail piece with a clearance and coaxially therewith, a resilient member contained in the clearance between said ring and said tail piece, a means of extracting connected to said tail piece by a rope, passages provided in said resilient member for the ends of said rope to be reeved therethrough stops provided on the inside surface of said tail piece, passages provided in the body of said stops for the ends of said rope to be reeved therethrough.

2. The apparatus as claimed in claim 1, wherein the surface of the resilient member, that of the ring and the inside surface of the tail piece are taper-shaped.

3. The apparatus as claimed in claim 1, wherein end-face stops with passages are provided on the ring.

4. The apparatus as claimed in claim 2, wherein end-face stops with passages are provided on the ring.

* * * * *